US005435261A

United States Patent [19]

Androus

[11] Patent Number: 5,435,261

[45] Date of Patent: Jul. 25, 1995

[54] FLOATABLE COOLER DEVICE

[76] Inventor: Robert Androus, 432 W. 24th St., San Bernardino, Calif. 92405

[21] Appl. No.: 174,160

[22] Filed: Dec. 27, 1993

[51] Int. Cl.[6] ..... B65D 89/10

[52] U.S. Cl. ..... 114/256; 114/343

[58] Field of Search ..... 114/343, 256, 345, 351, 114/362, 361, 364; 441/35, 40; 220/560, 902

[56] References Cited

U.S. PATENT DOCUMENTS

| | | | |
|---|---|---|---|
| 1,657,786 | 1/1928 | Carmichael | 114/351 |
| 3,718,111 | 2/1973 | DelVecchio | 114/346 |
| 4,771,722 | 9/1988 | Tihany | 441/40 |
| 4,871,079 | 10/1989 | Doucette et al. | 220/1 R |
| 4,938,722 | 7/1990 | Rizley | 114/351 |
| 5,090,930 | 2/1992 | Walden | 114/346 |
| 5,131,348 | 7/1992 | Roy | 114/345 |

*Primary Examiner*—Stephen Avila
*Attorney, Agent, or Firm*—Poms, Smith, Lande & Rose

[57] ABSTRACT

A floatable cooler device including a hull, the hull having a forward storage compartment, a central cooler compartment and a fuel compartment below the cooler compartment and to the rear thereof. The device is tri catamaran-shaped at both the forward end or bow thereof and the rear end or stern thereof.

11 Claims, 3 Drawing Sheets

FIG. 1
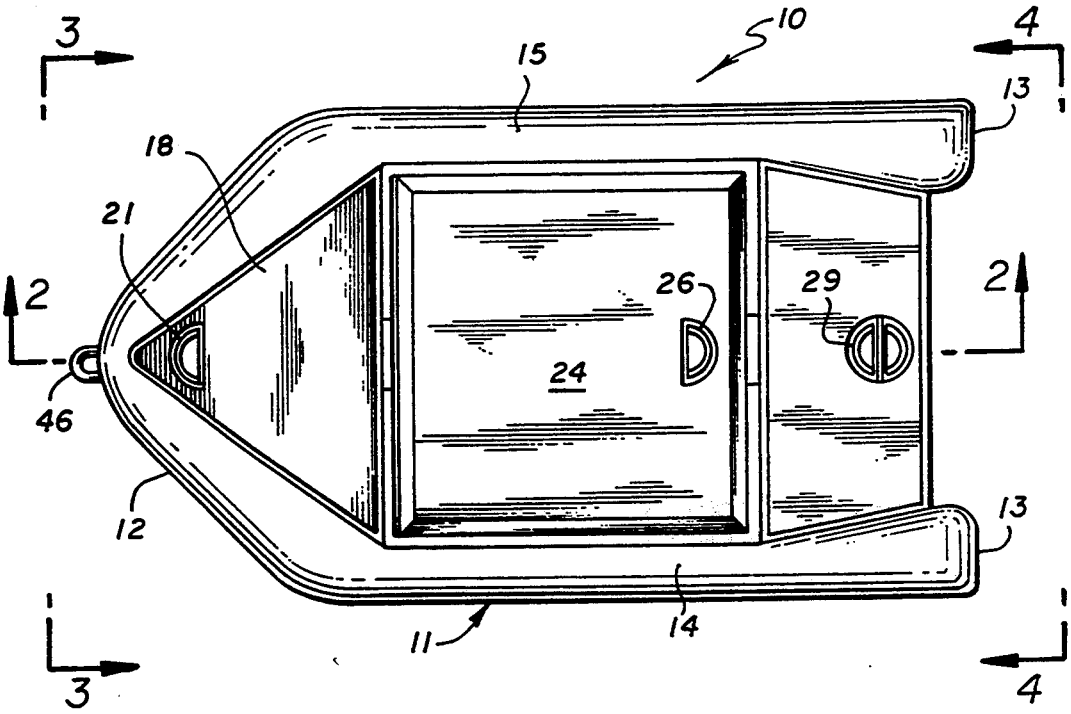
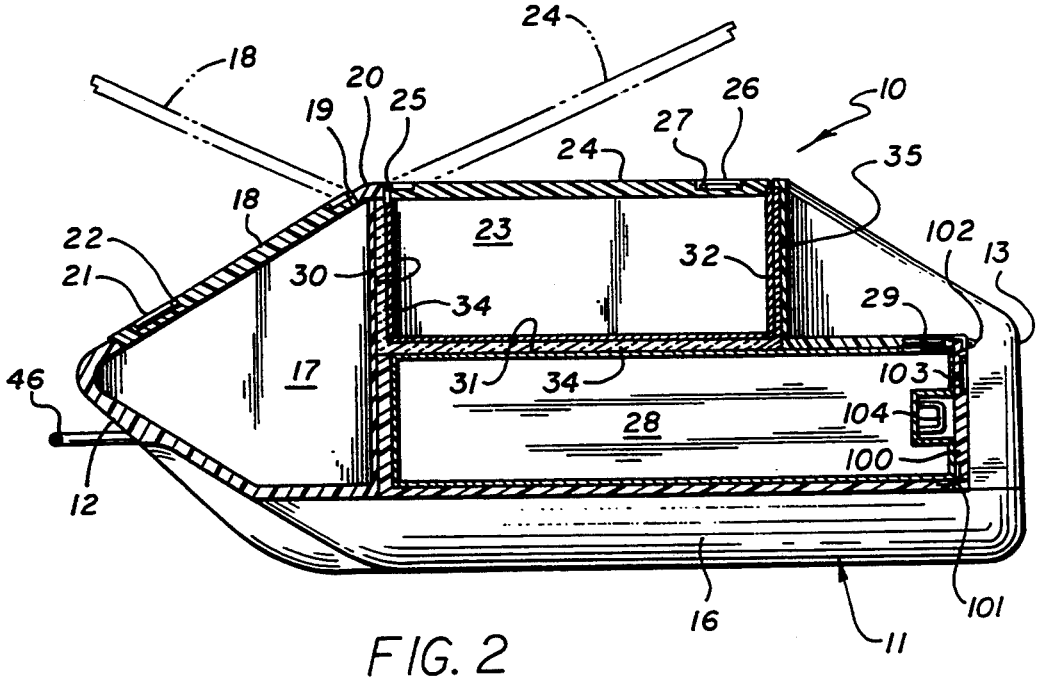
FIG. 2

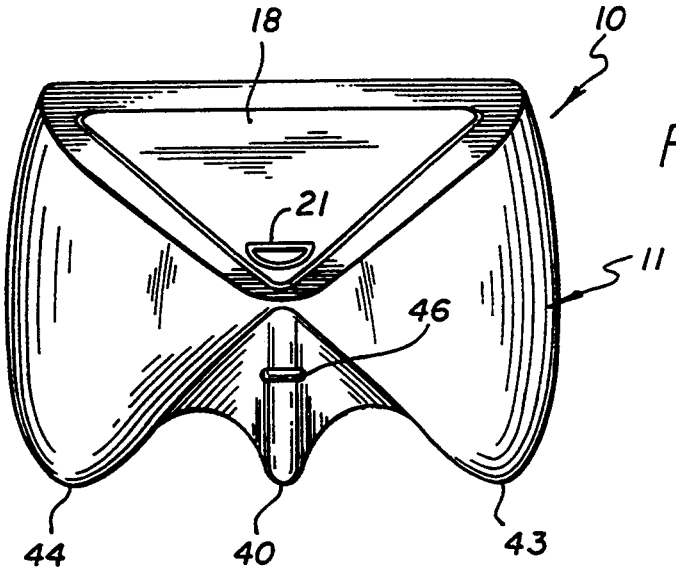
FIG. 3
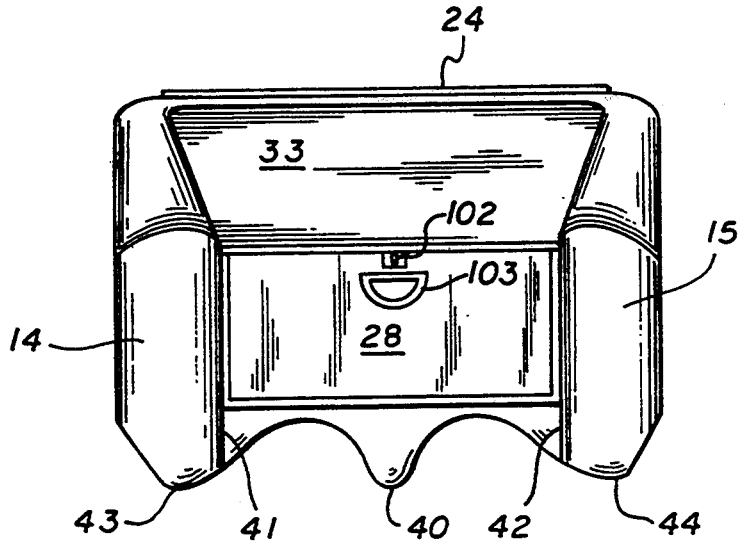
FIG. 4
FIG. 5
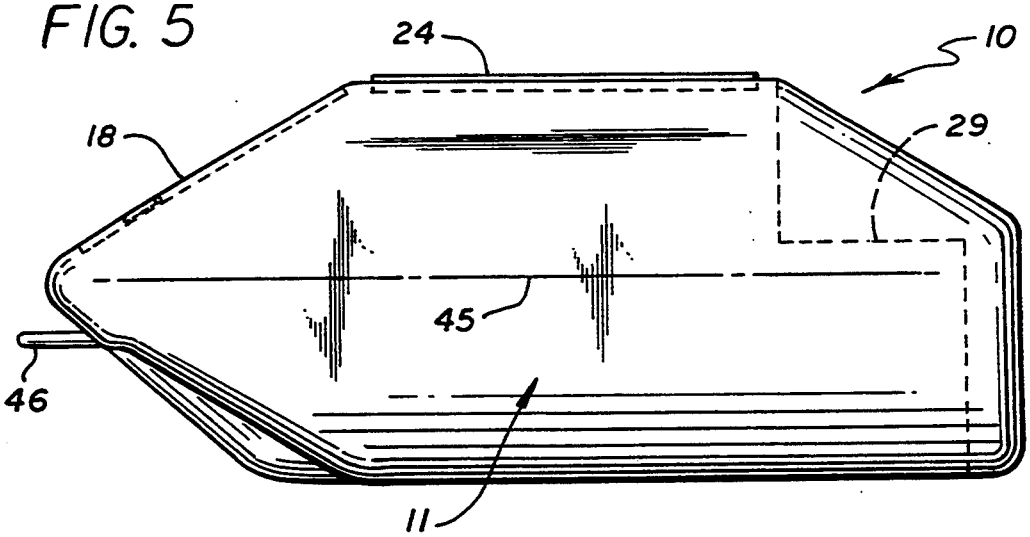

105
35
26
27
24
24
25
20
19
18
18
22
21
46
12
17
30
34
23'
24
31
34
32
29
28'
102
13
103
104
100
101
11
16
d"
3"

FLOATABLE COOLER DEVICE

BACKGROUND OF THE INVENTION

1. Field of the Invention

The invention relates to floatable cooler devices; and, more particularly, a towable floating cooler which is stable in the water and can be towed at relatively fast speeds.

2. Description of the Prior Art

There are many uses for towable floating coolers. Many people have boats, or rent boats, which do not have facilities thereon for cooling foods and liquids. Further, such boats are usually quite small and have only limited fuel storage and general storage thereon.

Although certain types of floating devices have been suggested in the past, such as the floatable cooler chest described in U.S. Pat. No. 4,871,079 to Doucette, et al., they are not designed to be towed at relatively fast speeds. Such a chest, due to the hull design and weight distribution, is limited to use with slow moving boats or in a stationary position.

There is thus a need for a towable floating cooler which can be towed at relatively high speeds and has a cooler and fuel storage thereon in addition to general storage.

SUMMARY OF THE INVENTION

It is an object of this invention to provide an improved floatable cooler.

It is a further object of this invention to provide a floatable cooler which can be towed safely at relatively high speeds.

It is still further an object of this invention to provide a towable floating cooler which, in addition to a cooler, has fuel and general storage thereon.

These and other objects are preferably accomplished by providing a floatable cooler device including a hull, a forward storage compartment, a central cooler compartment and a fuel compartment below the cooler compartment and to the rear thereof. The device is tri catamaran-shaped at both the forward end or bow thereof and the rear end or stern thereof.

BRIEF DESCRIPTION OF THE DRAWING

FIG. 1 is a top plan view of the towable floatable cooler device in accordance with the teachings of the invention;

FIG. 2 is a view taken along lines 2—2 of FIG. 1;

FIG. 3 is a view taken along lines 3—3 of FIG. 1;

FIG. 4 is a view taken along lines 4—4 of FIG. 1; and

FIG. 5 is an elevational view of the port side of the device of FIG. 1 (the starboard side elevational view being identical)

DESCRIPTION OF THE PREFERRED EMBODIMENT

Figure 6:
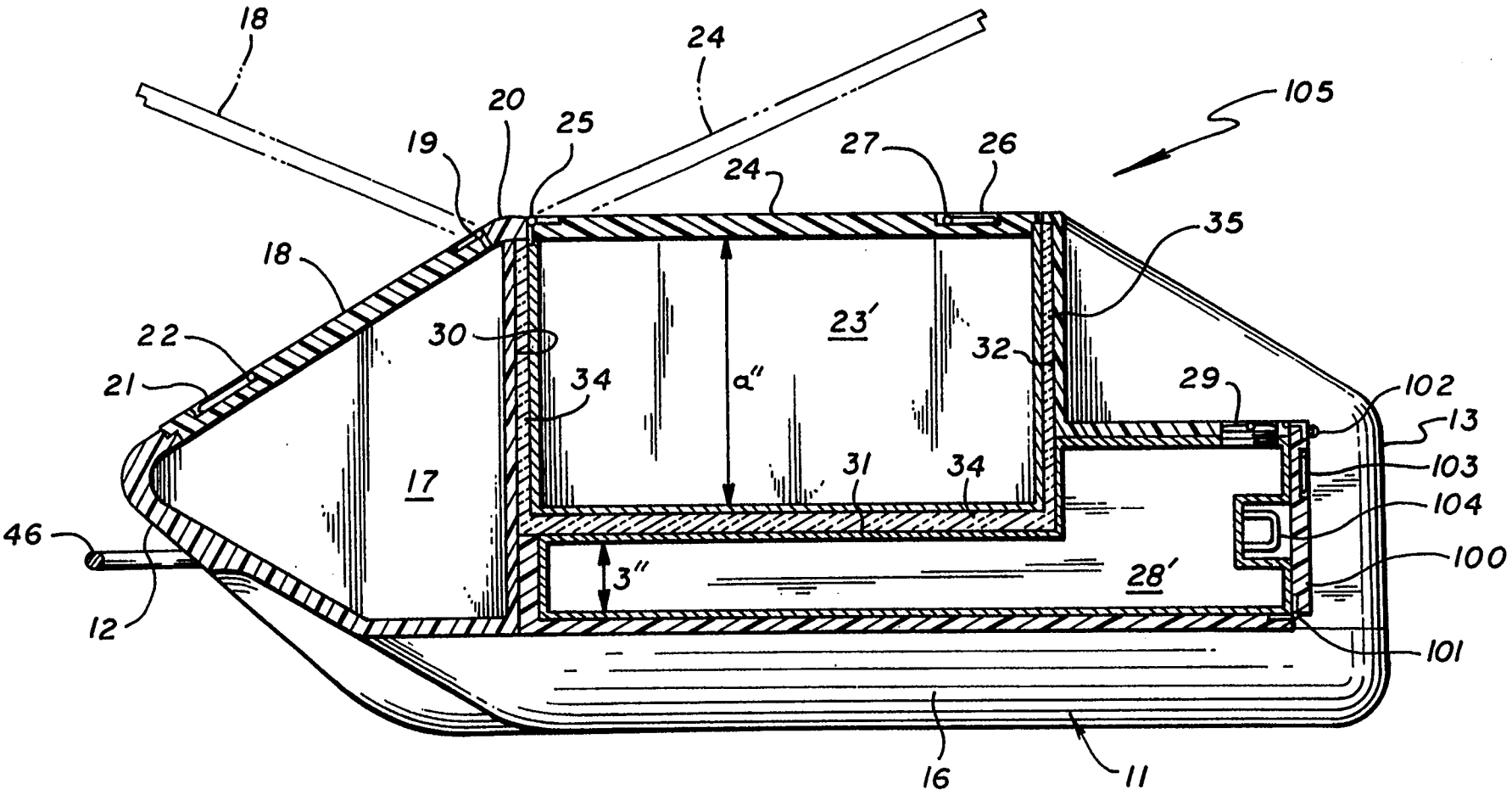
FIG. 6 is a view similar to FIG. 2 showing a modification of the device.

Referring now to FIG. 1 of the drawing, a floatable cooler device 10 is shown in top plan view having a hull 11 comprised of a forward end or tapered bow 12, and a rear end or stern 13 and port and starboard sides 14, 15, respectively. As seen in FIG. 1, stern 13, bow 12 and the sides 14, 15 are integral thus forming hull 11. As seen in FIG. 2, a bottom portion 16 of hull 11 is also integral with portions 13, 12, 14 and 15.

The area of hull 11 between sides 14, 15, and the bow 12 and stern 13 and above bottom portion 16 is comprised of three compartments. The first or forward compartment 17 is for general storage, such as clothes, one's belongings, etc. A door 18 closes off compartment 17 (see also FIG. 1), hinged at hinge 19 to framing 20 and open and closed by pulling on a finger pull latch 21 hinged to door 18 at hinge 22. As seen in FIGS. 1 and 2, framing 20 extends from bow 12 to stern 13 and encompasses the various compartments discussed.

Thus, a second or midcompartment 23 is provided rearwardly of storage compartment 17, closed off at top by door 24 (see also FIG. 1) hinged to framing 20 at hinge 25. A finger pull latch 26 is provided in door 24 hinged at hinge 27. Midcompartment 17 may be removable so one can take it with them.

A fuel storage compartment 28 is provided below cooler compartment 23 extending from adjacent storage compartment 17 past and below cooler compartment 23 and to a point adjacent the end of stern 13. This is best seen in FIG. 1. Fuel storage compartment 28 may also be removable for ease of use so it can be filled away from the food midcompartment 23.

As seen in FIGS. 1 and 2, a removable fuel cap 29 is provided adjacent stern 13 for access to fuel storage compartment 28.

As seen in FIG. 2, fuel compartment 28 is closed off at the rear by door 100 hinged at hinge 101. A lock or latch 102 may be provided along with handle 103. A recessed handle 104 may be provided for pulling storage compartment 28 out of device 10.

As seen in FIG. 2, a space 30 is provided between storage compartment 17 and cooler compartment 23; a space 31 is provided between cooler compartment 23 and fuel storage compartment 28; and a space 32 is provided between cooler storage compartment 23 and the vertical portion 33 of framing 20 adjacent cooler compartment 23. These spaces 30, 31 and 32 are filled with a suitable insulation material 34.

Any suitable dimensions may be used. For example, device 10 may be about 40" long, about 14' wide and about 12" high (compartment 23 being about 6½ high and compartment 28 being about 5½ high). The width of spacings 30, 31 and 32 may be about ¾ and compartments 23 may be about 16" long. Compartment 28 may be about 24" long. The undercut area 35 (FIG. 1) at stern 13 may extend inwardly about 2" and be about 14" wide, the width of sides 14, 15 being about 4". Compartment 17 may be about 12" long and about 12" high (tapering from front to rear as seen in FIG. 1 and undercut at the bottom as seen in FIG. 2). The height of bottom portion 16 may be about 4".

Hull 11 is undercut at the bow as seen in FIG. 2. This is of course due to the tri-hull shape of hull 11 as seen in FIG. 3. The tri-hull shape of hull 11 is seen in FIG. 4. Also as seen in FIG. 4, the spacing between center hull bottom portion 40 and the junction 41 of side 14 with fuel storage compartment 28 may be about 7" (and also the distance between portion 40 and junction 42 of side 15 with compartment 28 may be about 7"). The hull bottom portion 40, along with hull bottom portions 43, 44, may be rounded as shown (see also FIG. 3).

As seen in FIG. 5, the center of gravity 45 of device 10 is about 8" between the top and bottom of device 10. A towing eye 46 (FIG. 1) may be provided at bow 12 for towing device 10.

Any suitable materials can be used, such as styrofoam, wood, etc.

It can be seen that I have disclosed a towable device which has a tri-hull configuration and compartment distribution (whether loaded or empty) that adds stability while being towed at speeds of 15 to 20 miles per hour. The device 10 can carry food and beverages in cooler compartment 23, clothes and other belongings in storage compartment 17 and fuel in fuel storage compartment 28. As seen in FIG. 2, fuel storage compartment is about 5½" high, about 14" wide (FIG. 1) and about 24" long. Thus, an appreciable quantity of fuel can be carried by device 10. Storage compartment 18 can also be used to carry tools and all of the doors can be provided with locks, if desired. The cooler section 23 and fuel compartment 28 may be removed as heretofore discussed.

As seen in FIG. 6, wherein like numerals refer to like parts of the device 10 of FIGS. 1 to 5, device 105 is shown wherein cooler midcompartment 23' otherwise similar to compartment 23, extends downwardly deeper than compartment 23, e.g., 9" in depth. The fuel compartment 28' is thus L-shaped in cross-section having a depth of about 3" below compartment 23'.

It can be seen that I have disclosed a towable floating device for food, beverage, clothing, tools and fuel storage all in one well stabilized and easily towable unit. Although I have disclosed a particular embodiment of the invention, variations may occur to an artisan and the scope of the invention is only intended to be limited by the scope of the appended claims.

I claim:

1. A towable non-powered, non-inflatable floatable storage device comprising:

a hull having a tri-shaped bottom portion, a tapered bow and a stern, said hull also having port and starboard side portions extending from the bow to the stern, said stern, bow and port and starboard sides being integral and forming said hull;

a removable forward storage compartment disposed at the bow;

a removable rear fuel storage compartment extending from the forward storage compartment to the stern; and a cooler compartment disposed rearwardly of the storage compartment and above the fuel storage compartment and insulated from both the storage compartment and the fuel storage compartment.

2. In the device of claim 1 including a selectively closable door mounted to said storage compartment.

3. In the device of claim 1 including a selectively closable door mounted to said storage compartment.

4. In the device of claim 1 including a selectively closable fuel cap closing off access to said fuel storage compartment at said stern and rearwardly of said cooler compartment.

5. In the device of claim 1 wherein said storage forward compartment extends from said hull bottom to the top of said device and is generally triangularly-shaped in cross-section.

6. In the device of claim 1 wherein the overall length of said device is about 40", the overall width is about 22" and the overall height is about 16".

7. In the device of claim 1 wherein said cooler compartment is about 16" long and about 6½" high.

8. In the device of claim 1 wherein said fuel storage compartment is about 5½" high and about 24" long.

9. In the device of claim 1 wherein said device is about 16" high and the center of gravity is about midway between the top and bottom thereof.

10. In the device of claim 1 wherein said cooler compartment is about 16" long and about 9" high.

11. In the device of claim 10 wherein said fuel storage compartment is about 24" long and about 3" high below said cooler compartment and about 5½" high rearwardly thereof.

* * * * *